US009192962B2

(12) United States Patent
Schmidt et al.

(10) Patent No.: US 9,192,962 B2
(45) Date of Patent: Nov. 24, 2015

(54) VIBRATION EXCITER FOR GENERATING A DIRECTED EXCITATION VIBRATION

(75) Inventors: Christian Schmidt, Halsenbach (DE); Jens Wagner, Boppard (DE)

(73) Assignee: BOMAG GmbH, Boppard (DE)

( * ) Notice: Subject to any disclaimer, the term of this patent is extended or adjusted under 35 U.S.C. 154(b) by 547 days.

(21) Appl. No.: 13/565,899

(22) Filed: Aug. 3, 2012

(65) Prior Publication Data

US 2013/0055835 A1 Mar. 7, 2013

(30) Foreign Application Priority Data

Sep. 2, 2011 (DE) ..... 10 2011 112 316

(51) Int. Cl.
*B06B 1/16* (2006.01)

(52) U.S. Cl.
CPC ..... *B06B 1/166* (2013.01); *Y10T 74/18552* (2015.01)

(58) Field of Classification Search
CPC ..... B06B 1/166; B06B 1/164; B06B 1/161; B06B 1/162; B06B 1/16; B06B 1/167; B06B 1/186; Y10S 416/50; E02D 3/074; E02D 3/026; E01C 19/286; E01C 19/38
USPC ..... 74/61, 87, 424.86, 570.1–571.11, 1 SS; 404/117
See application file for complete search history.

(56) References Cited

U.S. PATENT DOCUMENTS 2,206,386 A * 7/1940 Bernhard ..... 74/61
2,248,182 A * 7/1941 Mateer ..... 74/61
2,258,217 A * 10/1941 Robins ..... 74/61

(Continued)

FOREIGN PATENT DOCUMENTS

DE 27 36 264 A1 3/1979
DE 100 38 206 A1 2/2002

(Continued)

OTHER PUBLICATIONS

Espacenet, English Machine Translation of Application No. FR894514A, published Dec. 27, 1944, retrieved from http://worldwide.espacenet.com on Aug. 1, 2012 (10 pages).

(Continued)

*Primary Examiner* — William Kelleher
*Assistant Examiner* — Zakaria Elahmadi
(74) *Attorney, Agent, or Firm* — Wood, Herron & Evans, LLP

(57) ABSTRACT

The present invention relates to a vibration exciter for generating a directed excitation vibration, especially for installation in a vibration tamper, and a machine with such a vibration exciter, comprising at least two parallel extending unbalance shafts which are rotatable against one another, on which at least one respective fixed unbalance mass and at least one respective movable unbalance mass are arranged, with the positions of the movable unbalance masses on the unbalance shafts being variable by way of an adjusting device for adjusting the amplitude of the exciter vibration, and with the adjusting device comprising a central adjusting element for amplitude adjustment which acts on the movable unbalance masses of the two unbalance shafts, which central adjusting element is arranged coaxially to a rotational axis ($A_S$) about which the vibration exciter is rotatable for the purpose of vector adjustment of the excitation vibration.

15 Claims, 10 Drawing Sheets

(56) References Cited

U.S. PATENT DOCUMENTS

| | | | | |
|---|---|---|---|---|
| 2,309,172 | A * | 1/1943 | De Kanski | 209/367 |
| 2,627,849 | A * | 2/1953 | Carlson | 123/197.1 |
| 3,000,278 | A * | 9/1961 | Kaltenegger | 404/117 |
| 3,287,983 | A * | 11/1966 | Austin et al. | 74/61 |
| 3,625,074 | A * | 12/1971 | Waschulewski et al. | 74/61 |
| 3,640,508 | A * | 2/1972 | Reibig | 366/116 |
| 3,832,080 | A * | 8/1974 | Stoecker | 404/133.1 |
| 4,412,757 | A * | 11/1983 | Kummel et al. | 404/113 |
| 4,561,319 | A * | 12/1985 | Lilja | 74/61 |
| 5,010,778 | A * | 4/1991 | Riedl | 74/61 |
| 5,177,386 | A * | 1/1993 | Shimada | 310/81 |
| 6,321,610 | B1 * | 11/2001 | Sekiguchi | 74/61 |
| 8,881,612 | B2 * | 11/2014 | Wagner | 74/61 |
| 2004/0003671 | A1 * | 1/2004 | Fervers et al. | 74/87 |
| 2004/0022582 | A1 * | 2/2004 | Sick | 404/133.05 |
| 2004/0025608 | A1 * | 2/2004 | Fervers et al. | 74/1 SS |
| 2004/0103730 | A1 * | 6/2004 | Riedl | 74/87 |
| 2004/0173040 | A1 * | 9/2004 | Laugwitz | 74/87 |
| 2004/0182185 | A1 * | 9/2004 | Niglov | 74/87 |
| 2006/0067796 | A1 * | 3/2006 | Riedl | 405/271 |
| 2010/0139424 | A1 * | 6/2010 | Wagner et al. | 74/61 |
| 2010/0147090 | A1 * | 6/2010 | Kuerten | 74/61 |
| 2011/0013990 | A1 * | 1/2011 | Richter et al. | 405/232 |
| 2012/0055276 | A1 * | 3/2012 | Wagner | 74/61 |

FOREIGN PATENT DOCUMENTS

| | | | |
|---|---|---|---|
| DE | 100 57 807 | A1 | 6/2002 |
| DE | 102 41 200 | A1 | 3/2004 |
| FR | 894514 | A | 12/1944 |

OTHER PUBLICATIONS

Espacenet, English Machine Translation of Application No. DE2736264A1, published Mar. 1, 1979, retrieved from http://worldwide.espacenet.com on Aug. 1, 2012 (8 pages).

Espacenet, English Machine Translation of Application No. DE10038206A1, published Feb. 21, 2002, retrieved from http://worldwide.espacenet.com on Aug. 1, 2012 (9 pages).

Espacenet, English Machine Translation of Application No. DE10057807A1, published Jun. 6, 2002, retrieved from http://worldwide.espacenet.com on Aug. 1, 2012 (6 pages).

Espacenet, English Machine Translation of Application No. DE10241200A1, published Mar. 25, 2004, retrieved from http://worldwide.espacenet.com on Aug. 1, 2012 (10 pages).

* cited by examiner

VIBRATION EXCITER FOR GENERATING A DIRECTED EXCITATION VIBRATION

CROSS-REFERENCE TO RELATED APPLICATIONS

The present application claims priority under 35 U.S.C. §119 of German Patent Application No. 10 2011 112 316.8, filed Sep. 2, 2011, the disclosure of which is hereby incorporated herein by reference in its entirety.

FIELD OF THE INVENTION

The present invention relates to a vibration exciter for generating a directed excitation vibration, especially for installation in a vibration tamper, comprising two unbalance shafts which extend in parallel and are rotatable against one another, on which at least one respective fixed unbalance mass and at least one respective movable unbalance mass are arranged, with the angular positions of the movable unbalance masses on the unbalance shafts being variable by way of an adjusting device for adjusting the amplitude of the exciter vibration.

Furthermore, the present invention relates to a machine and especially a construction machine such as a vibration tamper with a vibration exciter of the kind mentioned above.

BACKGROUND OF THE INVENTION

The aforementioned vibration exciters are known from the state of the art. They are used for generating a directed excitation vibration which can be introduced as alternating load impulses into the ground by way of suitable compaction means such as the tamping plates of a compaction device.

For this purpose, the vibration exciter comprises two unbalance shafts which extend in parallel with respect to each other, which are rotatable in opposite directions and on which at least one movable unbalance weight is arranged. The unbalance mass causes an excitation impulse in an excitation direction with a specific excitation amplitude during rotation of the shafts. This amplitude is directly linked to the compaction result during the excitation operation.

There may be a need, in the aforementioned vibration exciters, to change both the vibration amplitude by means of an adjustment of the amplitude and also the vector of said amplitude by means of a vector adjustment. The amplitude adjustment leads to a reduction in the vibration amplitude and consequently a reduction in the introduced load impulses, for example. The vector adjustment on the other hand causes a change in the direction of the vibration amplitude, so that a vibration tamper equipped with such a vibration exciter can be brought to forward and reverse operation, for example.

In order to perform an amplitude adjustment in the aforementioned "two-shaft exciter", the movable unbalance masses are arranged on the unbalance shafts, which unbalance masses are movable relative to fixed unbalance masses on the unbalance shafts and are especially rotatable on the same. As a result of such a motion, the resulting total unbalance mass can be influenced in such a way that the resulting excitation amplitude will increase or decrease.

Such an apparatus is described, for example, by DE 102 41 200 A1, in which two unbalance shafts which are rotatable with respect to each other and extend in parallel are also arranged in a vibration tamper for generating a directed excitation vibration. Movable unbalance masses are arranged on the two shafts, which unbalance masses can be changed by an adjusting device in their position relative to fixed unbalance masses. The amplitude of the vibration exciter can be influenced in this manner.

Similar apparatuses are also described in DE 100 57 807 and DE 100 38 206.

The disadvantage of the vibration exciters known from the state of the art lies on the one hand in the complex configuration of an adjusting device for the adjustment of the movable unbalance masses on the two unbalance shafts, and on the other hand in the lack of an effective vector adjustment and the possibility to enable such a vector adjustment in a simple and technically reliable manner.

SUMMARY OF THE INVENTION

The present invention is consequently based on the object of further developing a vibration exciter for generating a directed excitation vibration of the kind mentioned above in such a way that a reliable amplitude adjustment and vector adjustment of the excitation vibration is ensured in combination with a sturdy and cost-effective configuration.

This object is achieved by a vibration exciter for generating a directed excitation vibration, especially the installation in a vibration tamper, comprising at least two unbalance shafts which are rotatable in opposite directions with respect to each other and extend in parallel, on which at least one fixed unbalance mass and at least one movable unbalance mass are respectively arranged, in which the positions of the movable unbalance masses on the unbalance shafts are variable by way of an adjusting device for amplitude adjustment of the excitation vibration or for adaption of the excitation force, with the adjusting device having a central adjusting element for amplitude adjustment which acts on the movable unbalance masses of the two unbalance shafts, which is arranged coaxially to a rotational axis about which the vibration exciter is rotatable for the purpose of vector adjustment of the excitation vibration.

Furthermore, this object is achieved by a machine and especially a construction machine such as a vibration tamper with a vibration exciter of the kind described above.

In view of the present invention, the term of fixed unbalance mass shall be understood as being any unbalance mass which is arranged or provided on the unbalance shaft and which is in operative connection with the same and is not adjustable with the movable unbalance masses.

The present invention therefore principally relates to a vibration exciter in which both the amplitude as well as the vector of the excitation vibration or excitation force are adjustable. A relevant point of the vibration exciter in accordance with the present is the arrangement of an adjusting device for amplitude adjustment of the excitation force with a central adjusting element which acts simultaneously on both unbalance masses in order to change their relative position on the unbalance shafts in such a way that the vibration amplitude will change. Preferably, the adjusting device acts upon the unbalance masses in such a way that they will move relative to the fixed unbalance masses arranged in a stationary manner on the unbalance shafts. In summary, a vibration amplitude is obtained which is changed or can be changed.

It is further advantageous in the aforementioned central adjusting element to arrange its configuration in such a way that the vibration exciter can be rotatably positioned about the central adjusting element for the purpose of vector adjustment of the vibration amplitude or the excitation force. The central adjusting element therefore preferably acts not only as an adjusting element for the amplitude adjustment but also as a rotational axis or bearing for the vector adjustment. For the purpose of vector adjustment, the vibration exciter can rotate about the central adjusting element or a bearing element arranged in a respectively coaxial manner in relation to the central adjusting element (especially by 90°), so that the direction of the vibration amplitude will change. As a result, the vector adjustment can be used among other things to change a compaction amplitude directed orthogonally to the ground surface into a compaction amplitude acting horizontally in relation to the ground surface.

The rotational axis of the vector adjustment preferably extends coaxially with the main extension axis of the adjusting element, wherein the central adjusting element can also be arranged itself as a bearing axis or as a guide axis for a bearing, etc. As a result of the arrangement of the adjusting element coaxially to the rotational axis of the vector adjustment, a highly compact vibration exciter is obtained which is optimized with respect to the loads to be carried off. This advantage will be further amplified by arranging the central adjusting element as a rotational axis or as a bearing for such an axis itself.

Preferably, the central adjusting element is in operative connection with a first and second axial adjusting element via a yoke element, which axial adjusting elements extend in parallel to the two unbalance shafts and are in a spiral-groove driving engagement with the movable unbalance masses of the unbalance shafts in such a way that an axial movement of the central adjusting element causes a rotational motion of the movable unbalance masses about the respective unbalance shaft and therefore the amplitude adjustment. It is especially the arrangement of a central adjusting element which is in connection with the two axial adjusting elements via a yoke element that guarantees the compact and load-optimized arrangement of a vibration exciter. The yoke element is preferably arranged in such a way that it can dissipate both the axially acting adjusting forces for amplitude adjustment and also the tangentially acting rotational forces in vector adjustment.

The axial adjusting elements are preferably guided within the unbalance shafts for the technically compact configuration, wherein they will then engage with a driving pin in a spiral groove, which will then be in direct power connection with the respectively movable unbalance mass. The unbalance shafts are therefore preferably arranged at least in part as hollow shafts. As a result, a rotational force can be transmitted onto the respectively movable unbalance mass during an axial movement of the axial adjusting elements parallel to the main extension axis of the adjusting element. The movable unbalance mass is rotatably held, especially by way of a bearing element of the unbalance shaft, so that a rotation of the unbalance mass about the longitudinal axis of the unbalance shaft is enabled. It is obvious that any other kind of adjustable arrangement of the movable unbalance masses can be provided, which can then also be initiated by the central adjusting element on both unbalance shafts. An adjusting possibility is thereby obtained in combination with the fixed unbalance masses which are arranged in a stationary manner or on the unbalance shafts, which adjusting possibility can be operated in a very simple way via the central adjusting element.

Optimal bearing of the vibration exciter on or in a machine, and especially in a vibration tamper, is ensured when the central adjusting element comprises at least one rotational bearing element or is in operative connection with the same, by means of which the vibration exciter can be arranged on at least one external fixed point on the machine. As a result, the vibration exciter can be rotated relative to the machine for the vector adjustment about the central adjusting element or about its main extension axis.

Preferably, the main extension axis of the central adjusting element and therefore also the rotational axis of the vector adjustment extends coaxially to an axis of symmetry of the two unbalance shafts. As a result, both the longitudinal displacement for axial adjustment and also the rotation for producing the vector can be realized in a tension-optimized manner.

In one embodiment, the vibration exciter comprises a rotational force element for vector adjustment and an axial force element for amplitude adjustment. These two force elements are preferably arranged in such a way that they are or can be brought into operative connection with the central adjusting element in order to enable the vector or amplitude adjustment and in order to especially trigger a rotation about the axis of the adjusting element or its movement parallel thereto.

Both force elements can be active and also passive force elements. The arrangement as an actuating motor, chain drive, power cylinder, especially hydraulic cylinder, etc., is possible in an arrangement as active force elements. The arrangement of a coupling element which brings a force element into operative connection with the other force element can especially be considered as a passive force element, which will be described below in closer detail.

The rotational force element and the axial force element can further be arranged on one side of the vibration exciter and especially on one side of the central adjusting element. This enables a compact and cost-effective configuration.

Preferably, the rotational force element and the axial force element are functionally coupled with one another in such a way that during a vector adjustment and especially during the activation of the rotational force element, an amplitude adjustment will occur in an especially simultaneous fashion or at least coupled therewith, especially the activation of the rotational force element, or vice versa.

In particular, the rotational force element and the axial force element are functionally coupled with one another in such a way that during a vector adjustment of the resulting force component of the excitation vibration from a vertical direction in the direction of a horizontal setting an amplitude adjustment will occur in such a way that the resulting force component will be reduced or will be increased in the reverse adjusting direction. This means that during a change in the direction of the force vector from vertical in the horizontal direction there will also be an amplitude adjustment simultaneously, i.e., there will be a change in respect of the amount of the force component and especially its reduction. Such a combination takes the fact into account that in the case of a vertical active direction of the force component of the excitation vibration a strong compaction of the ground is ensured without leading to excessive loads in the machine. On the other hand, in the case of a horizontal active direction of the resulting force component of the excitation vibration there will be strong loads in the machine. As a result of a combination of vector adjustment and amplitude adjustment, this problem is taken into account, especially when the effective force is also simultaneously reduced during a change of the active direction from vertical to horizontal.

It is understood that this interaction can also be realized in a reverse way, so that the force component will be increased when adjustment is performed from the horizontal direction into the vertical active direction. All desired couplings can be realized here. This coupling can be achieved in a very simple way by a mechanical coupling between axial force element and rotational force element.

As described above, a passive force element can be understood as an axial force element within the scope of the present invention in addition to an axially acting force element that is or can be operated actively, e.g., a hydraulic cylinder or an axial adjusting motor. The same also applies to the rotational force element. Such a passive force element is in operative connection as a suitable coupling element with at least one other actively operated force element, so that in "trailing operation" it follows the activation of the other active force element. As a result, the axial force element can respectively be arranged as a passive axial force element, for example, and can be coupled with the rotational force element in form of a coupling arm, for example, so that it performs passive motions depending on the action of the rotational force element, which passive motions act as axial motions on the adjusting means. As described above, such an embodiment can also be realized in a reverse manner, i.e., with passive rotational force element and active axial force element, etc.

The above passive embodiment of an axial force element is characterized, for example, by a coupling element and especially by a coupling arm which can be arranged between the vibration exciter and an external fixed point of the machine and especially a vibration tamper, with the coupling element or the coupling arm being in a spiral-groove driving engagement with the central adjusting element so that a rotational motion initiated by the rotational force element on the vibration exciter is converted via the coupling element into an axial motion of the adjusting element. The spiral-groove driving engagement comprises a spiral groove on a central adjusting element, for example, which is arranged at least partly as a hollow shaft into which the coupling element engages with a complementary driver. During a rotation of the vibration exciter about the axis of the central adjusting element, said engagement produces an axial motion of the central adjusting element in the direction of its main extension axis and therefore the axial displacement of the central adjusting element and the two axial adjusting elements coupled therewith which is required for the amplitude adjustment.

As described in this connection, the central adjusting element is preferably arranged at least in part as a hollow shaft, which is arranged as a rotational shaft or as a rotational bearing shaft for the vector adjustment. At least one spiral groove is preferably arranged in the wall of said hollow shaft, into which a driver of the coupling element engages. In such an embodiment, the coupling element preferably comprises a coupling pin which is arranged coaxially to the central adjusting element and especially to its hollow shaft, and is guided within. The driver which protrudes especially radially from the coupling pin engages in the spiral groove in such a way that an axial force in the direction of the axis of the adjusting element is obtained during a rotation of the vibration exciter and therefore the hollow shaft. For this purpose, the coupling element and especially the coupling pin is preferably fixed in accordance with the present invention to the machine in a rotationally rigid fashion in such a way that it resists the rotation of the adjusting element and thereby causes the axial motion.

Preferably, the rotational force element comprises a length-variable lifting cylinder or a similarly length-variable power means which can be arranged in such an eccentric way in relation to the main extension axis of the central adjusting element on the vibration exciter and on and external fixed point of the machine and especially a vibration tamper, in particular, that with a change in length it causes a rotational motion of the vibration exciter about the axis of the central adjusting element.

BRIEF DESCRIPTION OF THE DRAWINGS

The present invention will be described below by reference to embodiments which are illustrated in the enclosed drawings, which schematically show the following.

The same reference numerals will be used below for the same or similarly acting components, with superscript indexes occasionally being used for differentiation purposes.

DETAILED DESCRIPTION OF THE INVENTION

Figure 1:
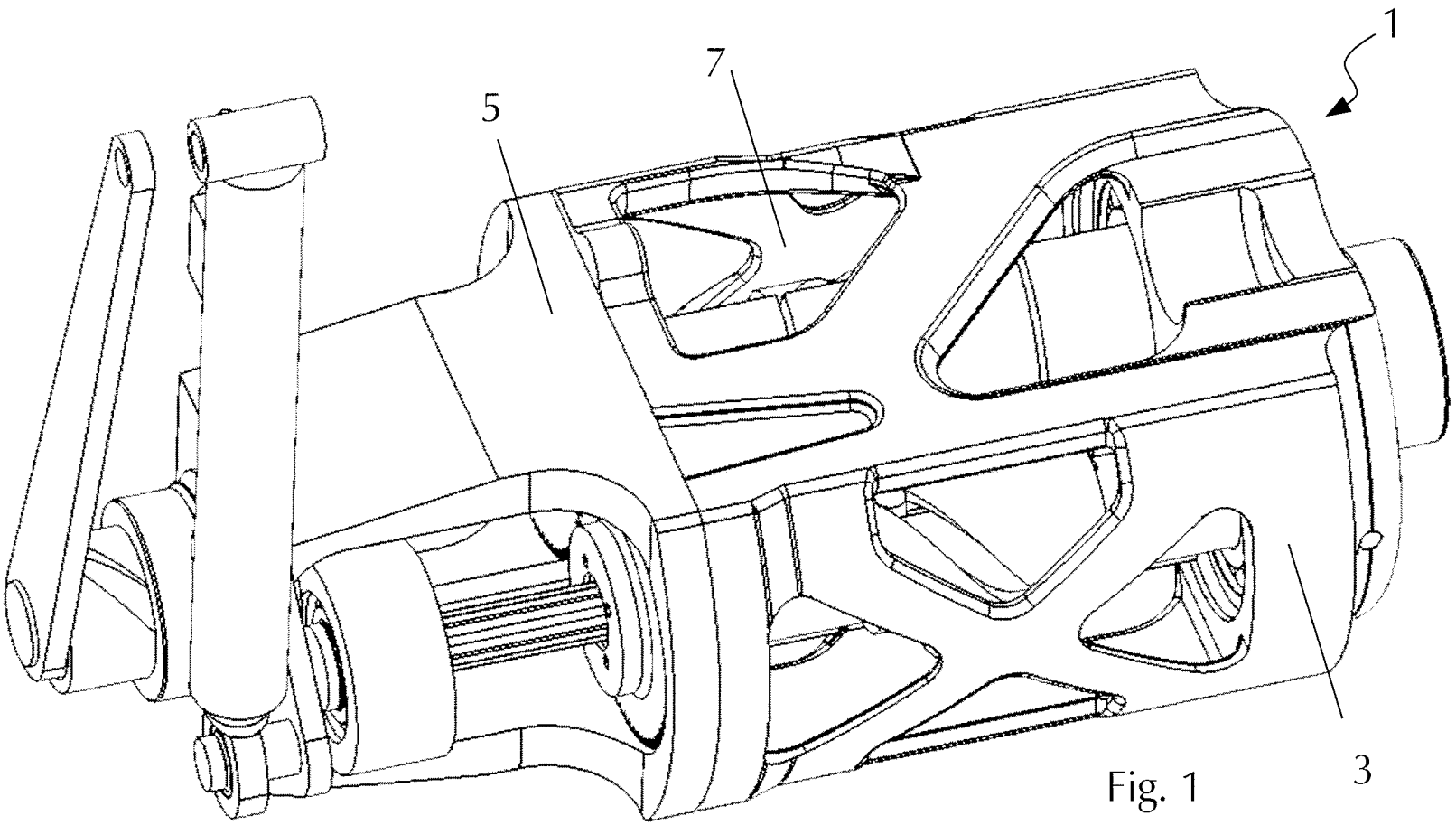
FIG. 1 shows an isometric view of an embodiment of a vibration exciter.

FIG. 1 shows an isometric view of an embodiment of the vibration exciter 1 in accordance with the present invention.

Figure 10:
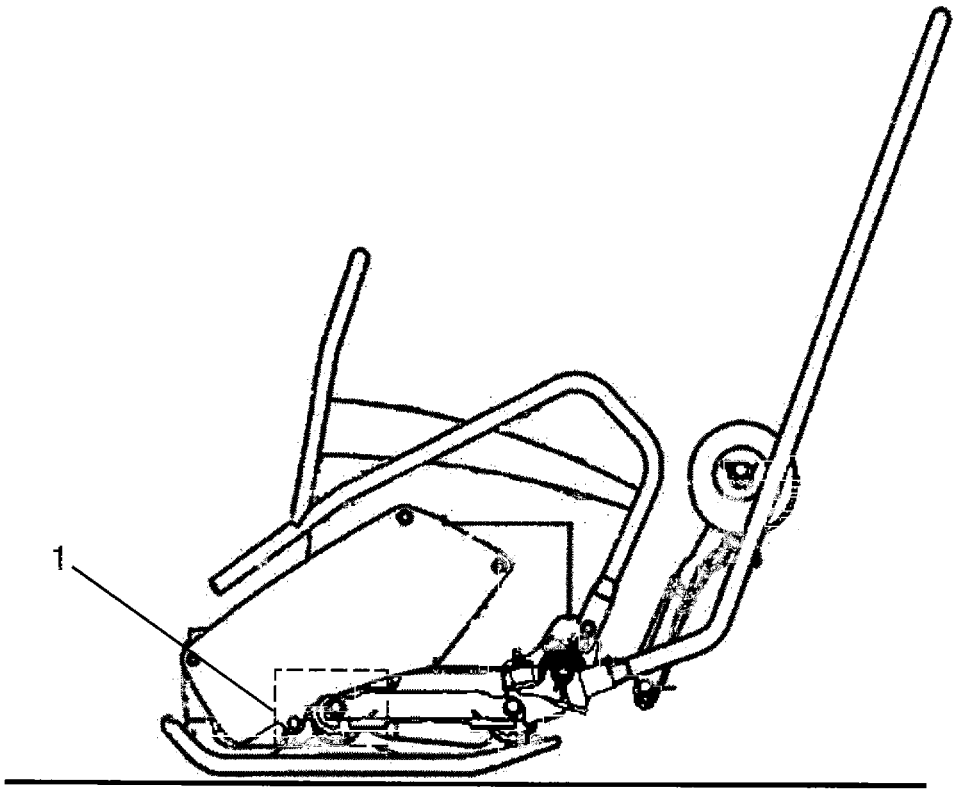
FIG. 10 is a plan view of an exemplary machine in the form of a vibration tamper incorporating the vibration exciter of FIG. 1.

The vibration exciter 1 comprises an exciter housing 3 with a housing head 5 forming a receiving space for excitation means 7 which allow producing a directed excitation vibration. The illustrated vibration exciter can be installed in a construction machine such as a vibration tamper as shown in FIG. 10.

Figure 2:
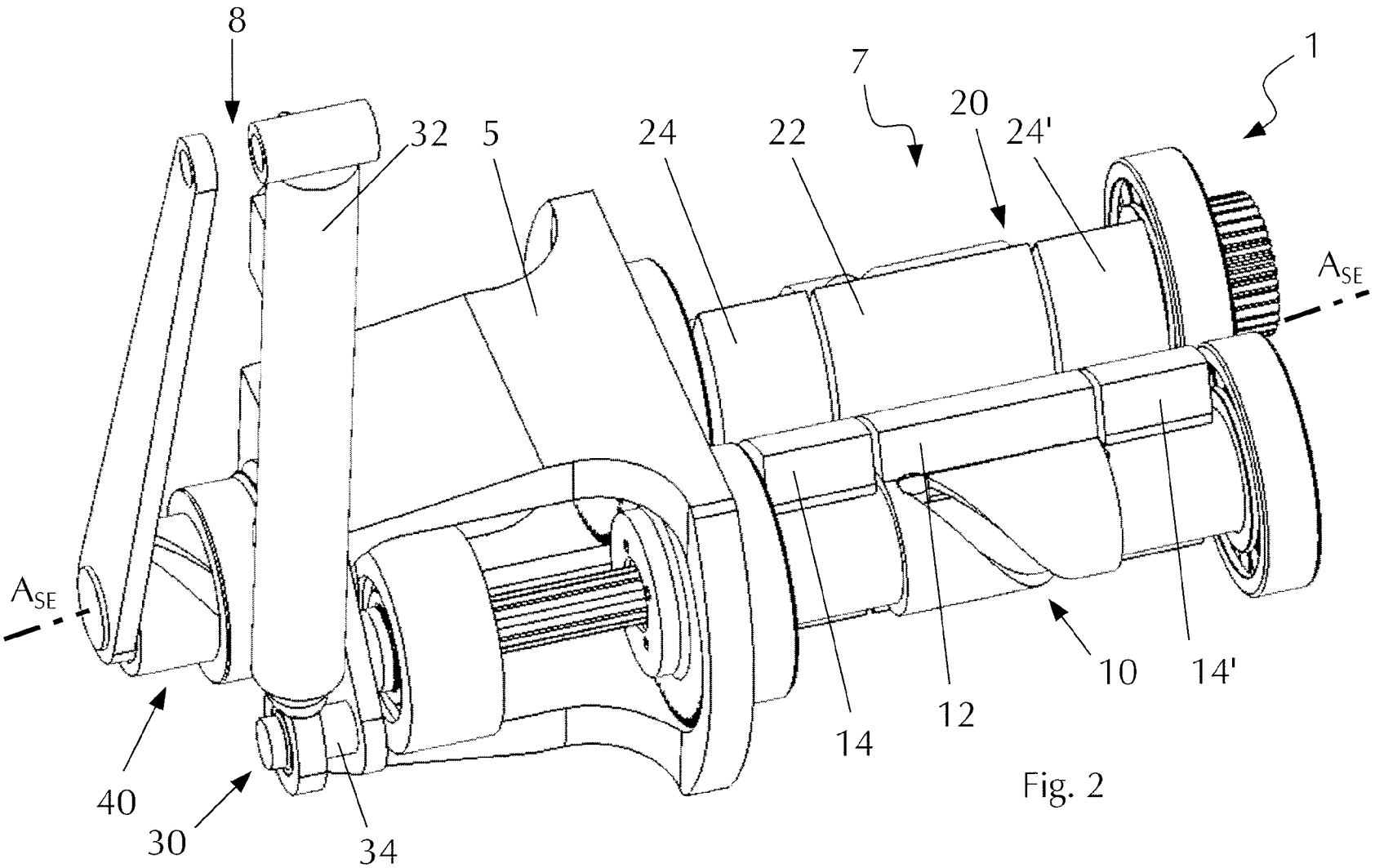
FIG. 2 shows the embodiment according to FIG. 1 with a partly sectional exciter housing.

FIG. 2 shows the embodiment according to FIG. 1, with the exciter housing having been partly removed so that the excitation means 7 are now clearly to be seen. The excitation means 7 concern two unbalance shafts 10, 20, on which both movable unbalance masses 12, 22 and also fixed unbalance masses 14, 24 are arranged.

The unbalance masses 12, 22 are movable via an adjusting device 2 comprising an axial force element 40 relative to the fixed unbalance masses 14, 24 and especially rotatable about the respective unbalance shaft 10, 20 in such a way that the amplitude of the excitation vibration will change during a rotation of the two unbalance shafts 10, 20.

Figure 3:
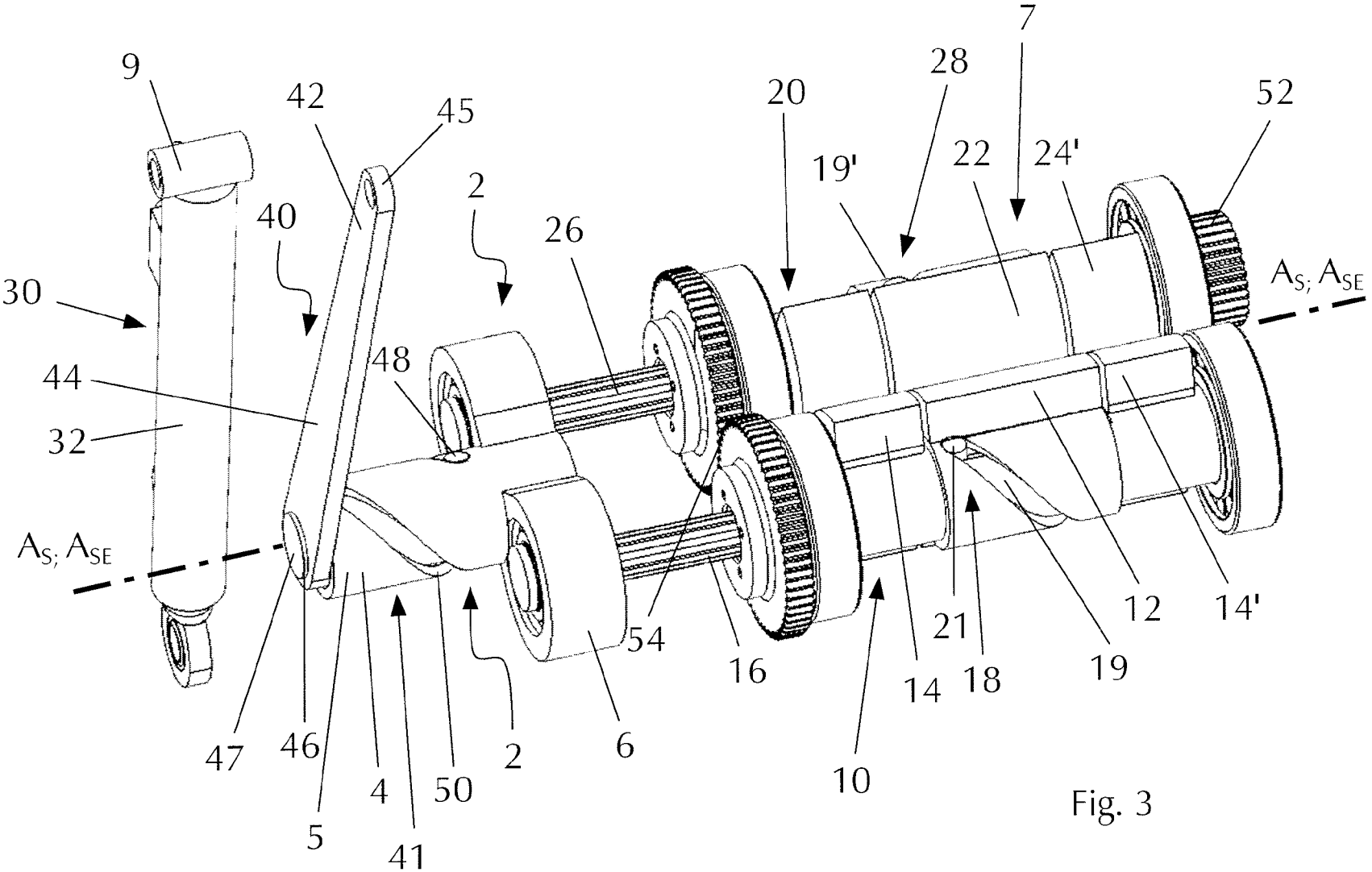
FIG. 3 shows the embodiment according to FIG. 1 with a completely removed exciter housing.

Furthermore, the vibration exciter 1 comprises a rotational force element 30, which is arranged in one embodiment as a lifting cylinder 32 and is eccentrically fixed to the housing head 5 in such a way that after a change in length it allows a rotation of the vibration exciter 1 about an axis $A_{SE}$, which in this case extends coaxially to the main extension axis of an adjusting element 4 (see FIG. 3).

The force elements as illustrated herein, i.e., the rotational force element 30 and the axial force element 40, consequently allow a vector adjustment (by rotation of the vibration exciter 1) about the axis $A_{SE}$ and an amplitude adjustment (by adjustment of the movable unbalance masses 12, 22). For the purpose of initiating this movement, the force elements 30, 40 fixed to a construction machine at least at one fixed point 8 (only shown schematically here), as will be described below in further detail. The fixed point 8 remains stationary in the case of a movement initiated by the force elements 30, 40.

FIG. 3 shows the illustration of FIG. 2 for the purpose of improved clarity of the illustration with completely removed exciter housing and with a slightly displaced force element 30.

The figure clearly shows the two unbalance shafts 10, 20 which comprise the movable unbalance masses 12, 22 and the fixed unbalance masses 14, 24. When rotated, these unbalance masses produce the directed excitation vibration. The drive of the two unbalance shafts 10, 20 is produced by a drive element and especially the drive gearwheel 52 which can be brought into operative connection with a motor (not shown). The two unbalance shafts 10, 20 are in operative connection with one another via a gearwheel meshing 54 in such a way that an oppositely directed rotational movement can be introduced into the unbalance shafts 10, 20 via the drive gearwheel 52.

As described above, the axial force element 40 is provided for adjusting the movable unbalance masses 12, 22, which axial force element introduces into two axial adjusting elements 16, 26 an axial motion along an axis of symmetry $A_S$ extending between the two unbalance shafts 10, 20. These axial adjusting elements 16, 26 are in a spiral-groove driving engagement with the movable unbalance masses 12, 22, so that a rotational movement of the movable unbalance masses 12, 22 relative to the fixed unbalance masses 14, 24 is obtained in an axial motion of the axial adjusting element 16, 26.

The coupling required for this purpose is based in this embodiment on one respective spiral groove 19 into which a driving pin 21 will engage in a non-positive manner, which driving pin on its part is connected in a non-positive manner with the respective axial force element 16 and 26. During an axial motion of the axial adjusting elements 16, 26, a rotation of the movable unbalance masses 12, 22 occurs as a result relative to the fixed unbalance masses 14, 24 or the unbalance shaft 10, 20.

In accordance with the present invention, the axial adjusting elements 16, 26 are connected via a yoke element 6 with the aforementioned central adjusting element 4, so that a synchronized axial motion of the two axial adjusting elements 16, 26 and therefore a synchronized adjustment of the movable unbalance masses 12, 22 are enabled by said central adjusting element 4. It is relevant in this connection that the spiral grooves 19 arranged on the two unbalance shafts 10, 20 are arranged in opposite directions, by means of which an adjustment in the opposite direction of the movable unbalance masses 12, 22 is achieved via the axial adjusting elements.

In accordance with the present invention, the central adjusting element 4 is further arranged in such a way that a rotation of the vibration exciter 1 (see especially FIG. 1) about the axis $A_{SE}$ of the central adjusting element $A_{SE}$ is possible, so that the central adjusting element not only allows amplitude adjustment (by movement of the movable unbalance masses 10, 20) but also a vector adjustment (by rotation of the excitation means 7 or the vibration exciter 1 about the axis $A_{SE}$).

As already described above with respect to FIG. 2, a rotational force element 30 with a lifting cylinder 32 is arranged on the vibration exciter 1 for the purpose of this vector adjustment, which occurs eccentrically in relation to the axis $A_{SE}$ of the central adjusting element 4 in such a way that an extension or reduction of the lifting cylinder 32 leads to a rotation of the vibration exciter 1 about said axis $A_{SE}$. For this purpose, the lifting cylinder 32 is fixed with one mounting end 9 to a fixed point of the machine in which the vibration exciter will be installed. In this embodiment, the axial force element 40 is coupled directly with the vector adjustment which can be initiated by the rotational force element 30 or the lifting cylinder 32, which axial force element is arranged in this case as a passive axial force element 40 and is in direct operative connection with the rotational force element 30.

For this purpose, the axial force element 40 comprises a coupling element 42 which can be arranged on the machine between the vibration exciter 1 and a further or the same external fixed point (not shown). The coupling element 42 is in a spiral-groove driving engagement 41 with the central adjusting element 4 in such a way that a rotational motion about the axis $A_{SE}$ which is initiated by the rotational force element 30 on the vibration exciter 1 is converted into an axial motion of the central adjusting element 4 parallel to the axis $A_{SE}$.

For this purpose, the central adjusting element 4 is arranged at least partly as a hollow shaft 38, with said shaft comprising a spiral groove 50 in its wall into which a driver 48 will engage in a non-positive manner. A coupling pin 46 which is arranged in a complementary manner engages in the interior space of the hollow shaft 38. A driver 48 is arranged on said coupling pin 46, which driver is in operative connection with the spiral groove 50.

A coupling arm 44 is arranged at the free end 47 of the coupling pin 46, which coupling arm is fixed with its free end 45 to the fixed point of the machine (not shown). As a result of the static coupling between the coupling element 42 or the coupling arm 44 and the fixed point, an axial displacement of the central adjusting element 4 along the axis $A_{SE}$ occurs during a rotation of the vibration exciter 1 about the axis $A_{SE}$ of central adjusting element 4. This means that in the case of a vector adjustment (which causes the rotation about the axis $A_{SE}$) there will also simultaneously be an amplitude adjustment. This on the other hand leads to the consequence that in the case of a vertically directed excitation vibration as occurs in FIGS. 1 to 5, for example, a maximum vibration amplitude or a maximum excitation force will act, whereas in the case of a substantially horizontally directed vibration amplitude or excitation force (as acts in FIG. 8, for example) the vibration amplitude itself will simultaneously also be reduced and consequently the loads on the vibration exciter 1 and the machine will be reduced.

Figure 4:
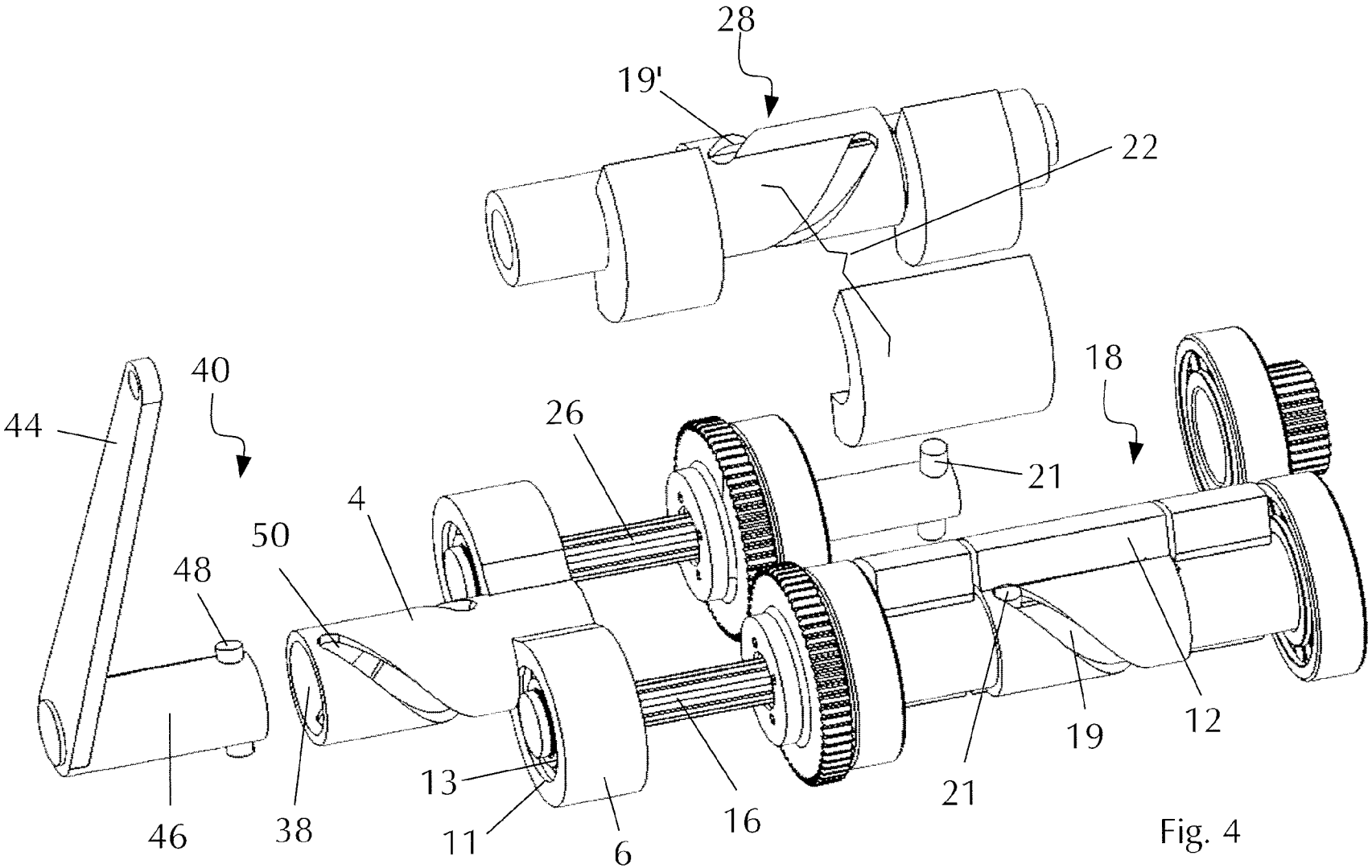
FIG. 4 shows the embodiment according to FIG. 3 as an isometric exploded view.
Figure 5:
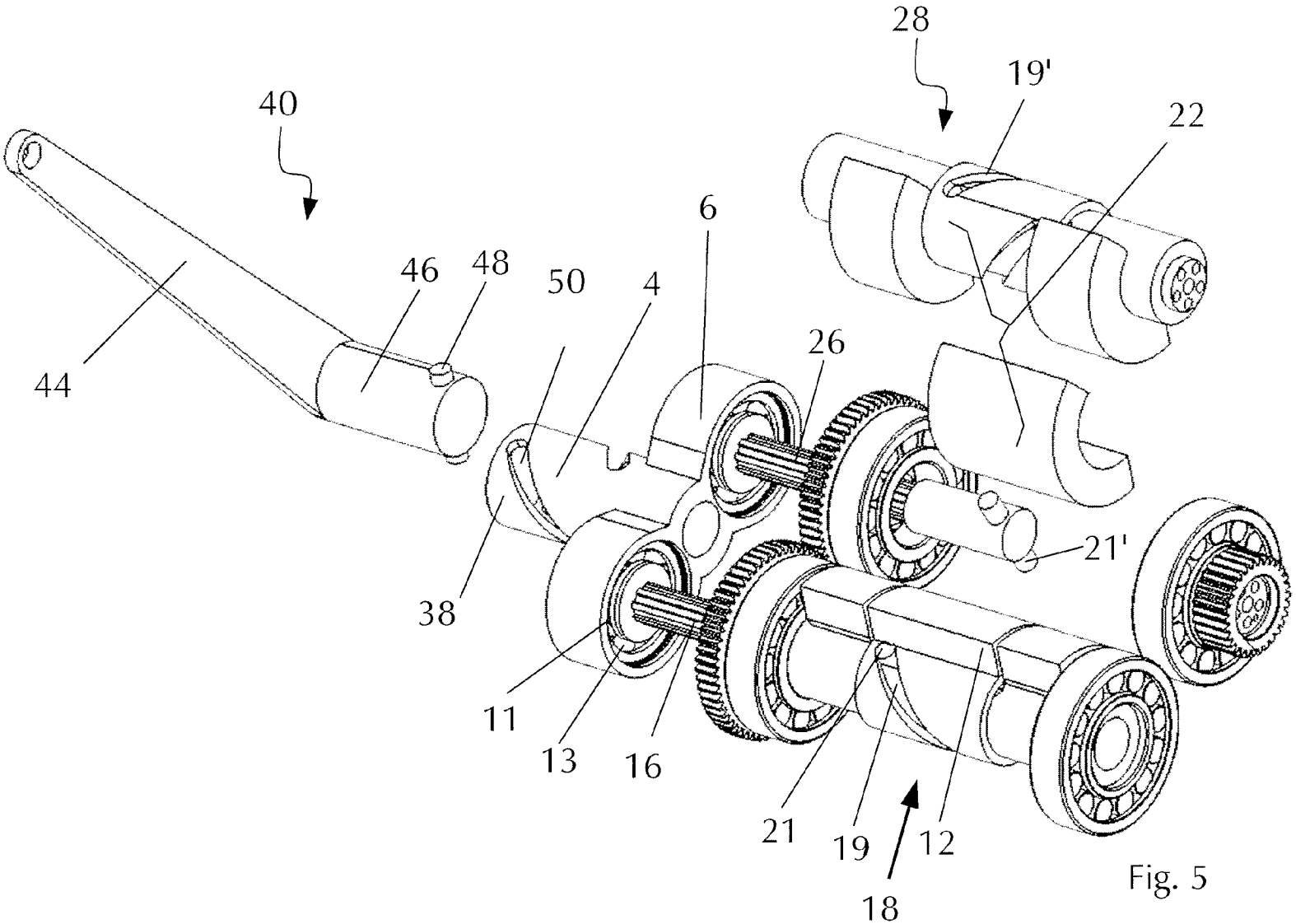
FIG. 5 shows the embodiment according to FIG. 4 from another angle of view.

FIGS. 4 and 5 show the embodiment as shown in FIG. 3 in a partly sectional view, with the illustration of the lifting cylinder 32 being omitted. The figure clearly shows the arrangement of the central adjusting element 4 as a hollow shaft 38 and the spiral groove 50 which is arranged therein and which is in operative engagement with the coupling pin 46 or its driver 48.

The figure also shows the embodiment of the spiral-groove driving engagements 18, 28, in which a spiral groove 19 on the movable unbalance masses 12, 22 is in operative engagement with a driving pin 21.

In order to enable a rotation of the axial adjusting elements 16, 26 relative to the yoke element 6, bearing elements 13 are provided in the respective receiving areas 11 in which the axial adjusting elements 16, 26 are held in a rotatable manner, but are fixed in the axial direction parallel to the axis $A_{SE}$.

Figure 6:
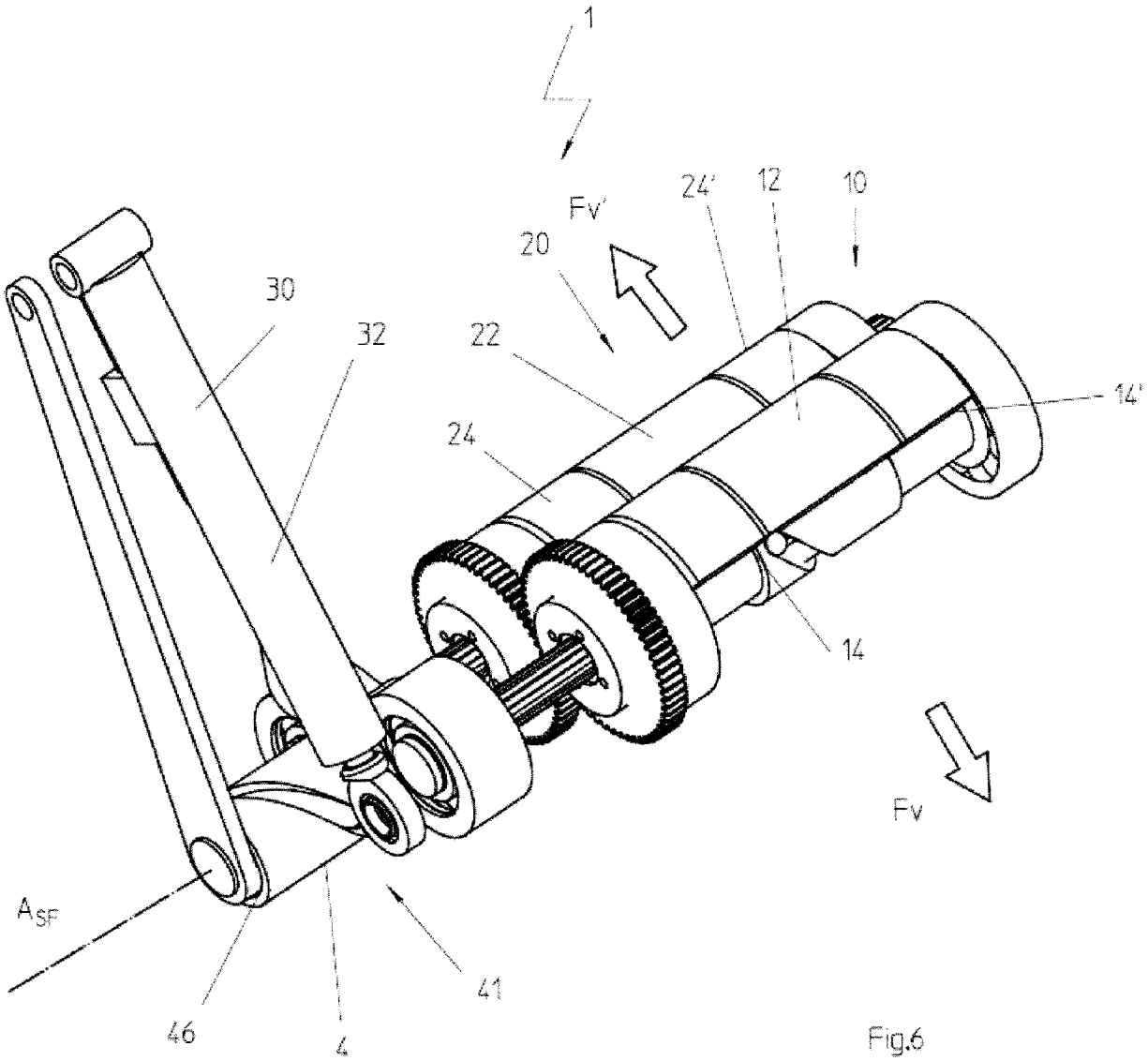
FIGS. 6-8 show isometric views of the embodiment according to FIG. 1 during the amplitude and vector adjustment.
Figure 7:
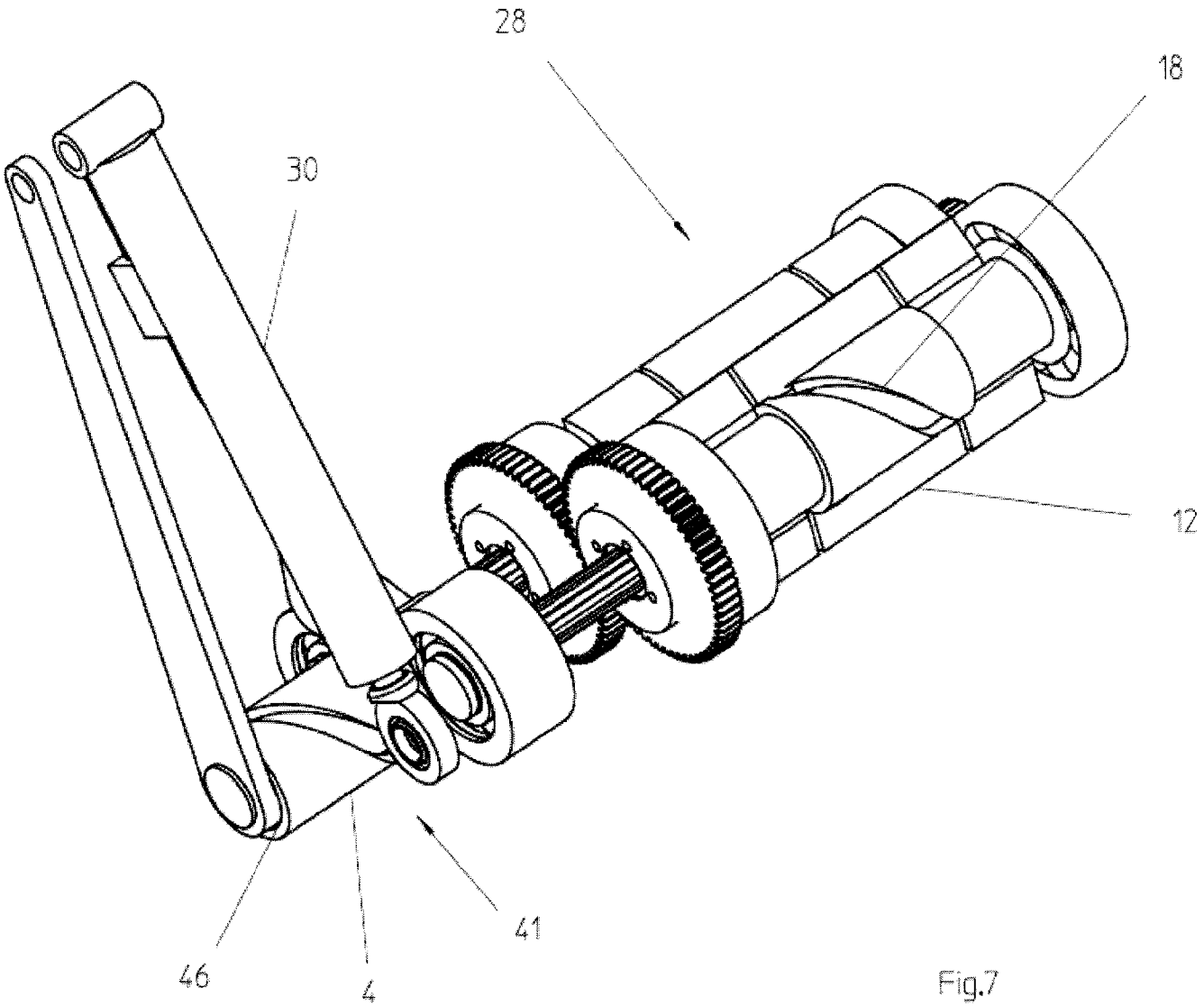
Figure 8:
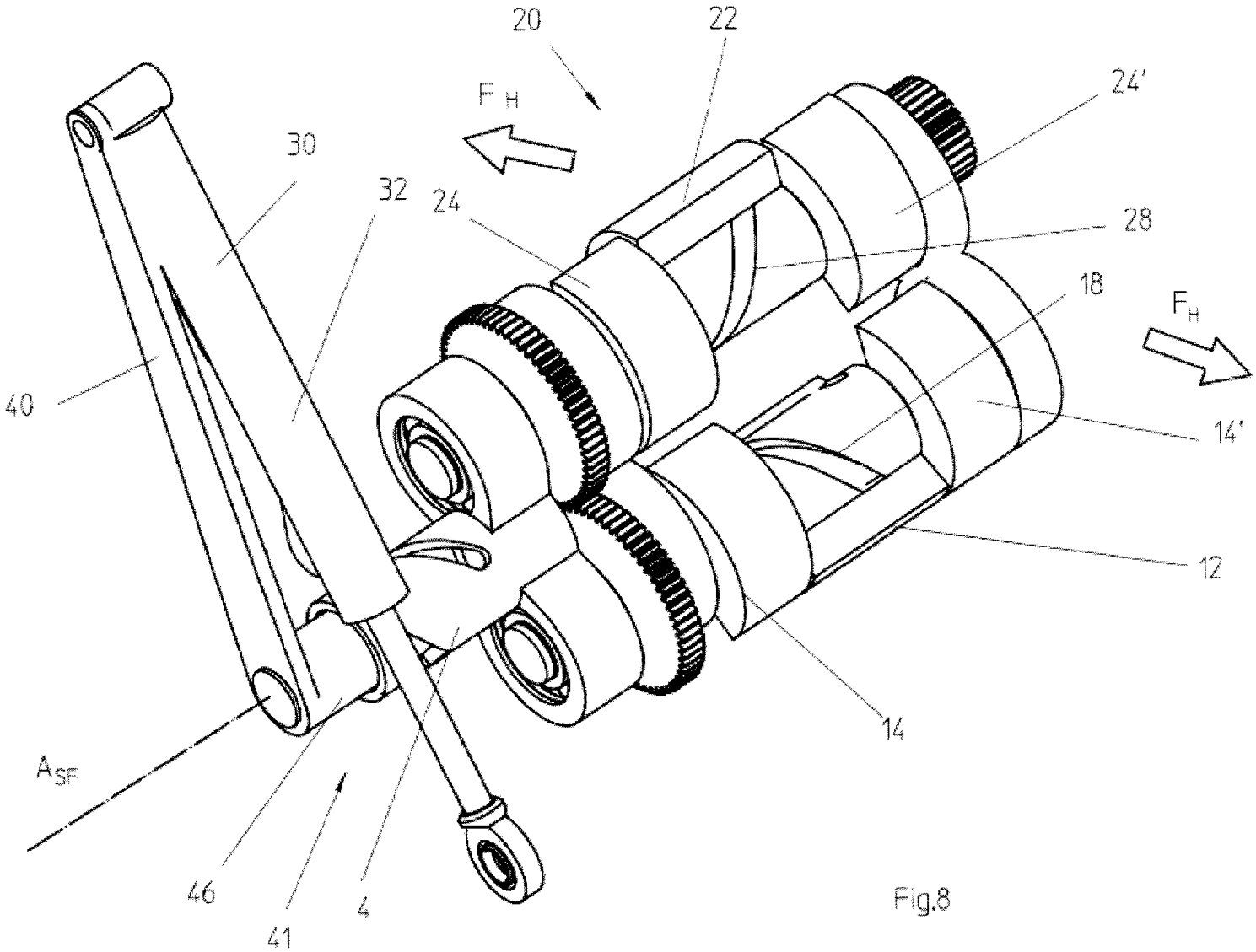

FIGS. 6 to 8 show the sequence of the combined amplitude and vector adjustment.

FIG. 6 shows the two unbalance shafts 10, 20 which are arranged substantially in a horizontal plane. The movable unbalance masses 12, 22 are further arranged relative to the fixed unbalance masses 14, 24 in such a way that a maximum vibration amplitude or a maximum excitation force $F_V$ is obtained in the vertical direction.

The vibration exciter 1 can be rotated about the axis $A_{SE}$ via the rotational force element 30 or the lifting cylinder 32 in such a way that the unbalance shafts 10, 29 no longer extend in a horizontal plane but in a vertical plane. This is shown in FIG. 8.

For this purpose, the lifting cylinder 32 is activated and changed in its position and especially extended, so that it twists the vibration exciter 1 about the axis $A_{SE}$ via its engagement on the eccentric pin 34 on the housing head 5 (see FIG. 2).

Simultaneously with this vector adjustment, an amplitude adjustment also occurs via the functional coupling between the rotational force element 30 and the axial force element 40, in that the movable unbalance masses 12, 22 are twisted relative to the fixed unbalance masses 14, 24. The result is a substantially horizontally directed, reduced vibration amplitude or excitation force $F_H$, which in this embodiment corresponds to a fraction of the vertically acting excitation force $F_V$.

In a summary of FIGS. 6 to 8 it will become clear how the coupling of the rotational force element 30 and the axial force element 40 causes the simultaneous vector and amplitude adjustment. As a result of the rotation of the vibration exciter 1 about the central adjusting element 4 caused by the lifting cylinder 32, an axial movement of the central adjusting element 4 occurs along the axis $A_{SE}$ on the coupling pin 46 as a result of the spiral-groove driving engagement 41, leading on its part to a rotation of the movable unbalance masses 12, 22 as a result of the spiral-groove driving engagements 18 or 28.

Figure 9:
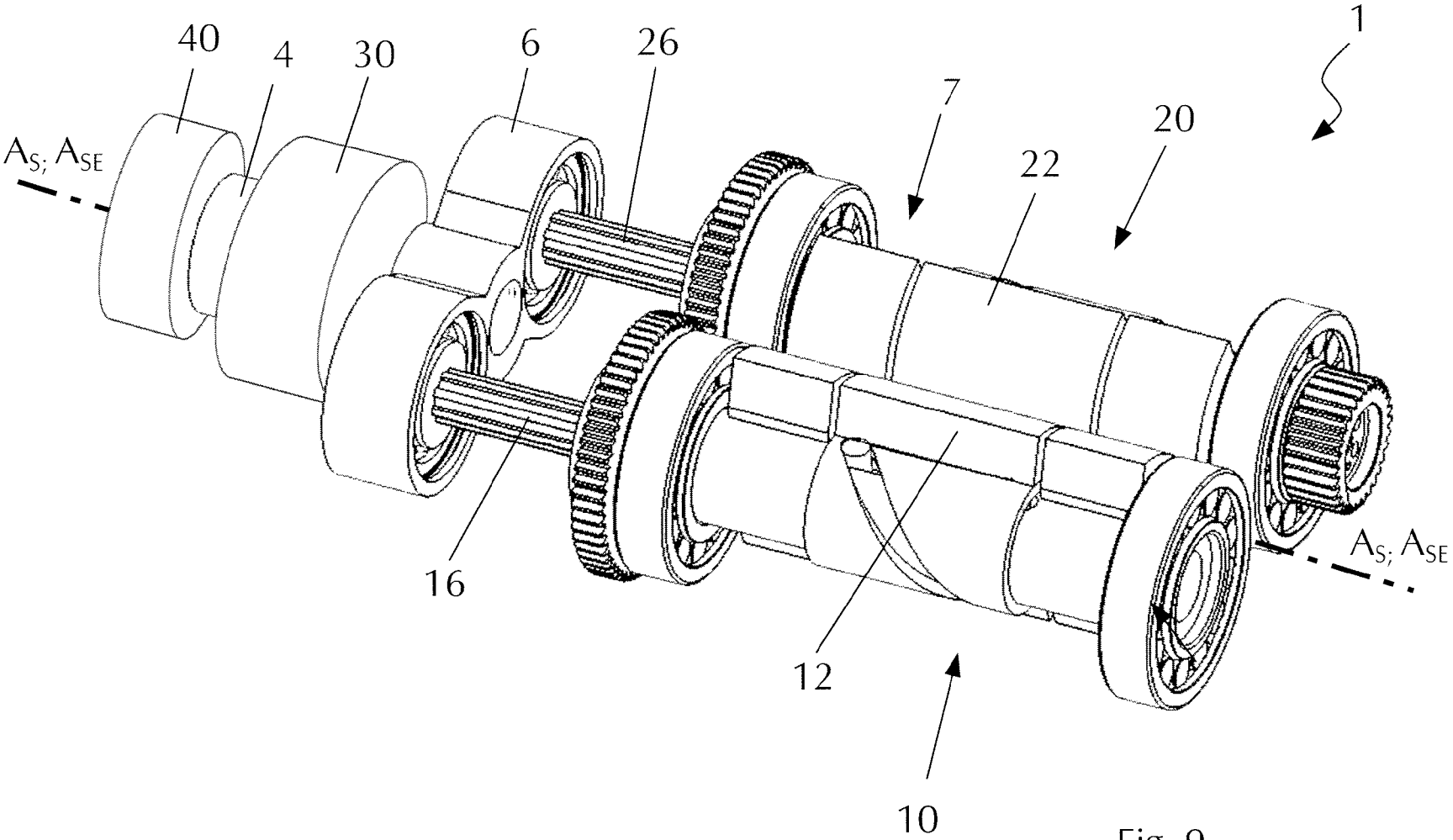
FIG. 9 shows an isometric view of a second embodiment of the vibration exciter in accordance with the present invention.

FIG. 9 shows a second embodiment of the vibration exciter in accordance with the present invention which with respect to its basic configuration substantially corresponds to the aforementioned vibration exciter according to FIGS. 1 to 8. In this case too, two unbalance shafts 10, 20 are arranged coaxially with respect to one another and symmetrically about an axis of symmetry $A_S$, and are coupled with one another in such a way that they rotate in opposite directions with respect to each other. The adjustment of the movable unbalance masses 12, 22 which are arranged on the unbalance shafts 10, 20 also occurs by two axial adjusting elements 16, 26 again, which are coupled with one another via a yoke element 6 and can be operated centrally by a central adjusting element 4.

In the embodiment as illustrated herein, two separately arranged force elements are arranged on the central adjusting element 4, which are an axial force element 40 and a rotational force element 30, which can each be activated separately for the amplitude adjustment or the vector adjustment. Therefore, the axial force element 40 enables the axial displacement of the central adjusting element 4 along its main extension axis $A_{SE}$ by means of an integrated hydraulic cylinder (not shown), which main extension axis extends coaxially to the axis of symmetry $A_S$.

The rotational force element 30 on the other hand allows the rotation of the central adjusting element 4 and therefore the rotation of the excitation means 7 or the vibration exciter 1.

In accordance with the present invention, both force elements 30, 40 are arranged on one side of the vibration exciter 1. This leads to a highly compact and cost-effective vibration exciter.

The coupling between the amplitude adjustment and the vector adjustment can also be produced in this embodiment by a suitable control device, with said control device especially being arranged in such a way that it controls the amplitude adjustment or the axial force element 40 simultaneously or by dependence when triggering the vector adjustment or the rotational force element 30, or vice versa.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of Applicants' invention.

What is claimed is:

1. A vibration exciter for generating a directed excitation vibration comprising:

at least two parallel extending unbalance shafts which are rotatable against one another, on which at least one respective fixed unbalance mass and at least one respective movable unbalance mass are arranged, with the angular positions of the movable unbalance masses on the unbalance shafts being variable by way of an adjusting device for adjusting the amplitude of the exciter vibration, wherein the adjusting device comprises a central adjusting element for amplitude adjustment which acts on the movable unbalance masses of the two unbalance shafts, which central adjusting element is arranged coaxially to a rotational axis ($A_S$) about which the vibration exciter is rotatable for the purpose of vector adjustment of the excitation vibration simultaneously with the amplitude adjustment, and further wherein the rotational axis ($A_s$) is offset from respective rotational axes of the at least two unbalance shafts.

2. A vibration exciter according to claim 1, wherein the central adjusting element is arranged as a rotational bearing element for the vibration exciter, so that the vibration exciter can rotationally be positioned about a main extension axis ($A_{SE}$) of the adjusting element for the purpose of vector adjustment of the excitation vibration.

3. A vibration exciter according to claim 1, wherein the central adjusting element is in operative connection with a first and second axial adjusting element via a yoke element, which axial adjusting elements extend parallel to the two unbalance shafts and are in a spiral-groove driving engagement with the movable unbalance masses of the unbalance shafts in such a way that an axial motion of the central adjusting element causes a rotational motion of the movable unbalance masses about the respective unbalance shaft and therefore the amplitude adjustment.

4. A vibration exciter according to claim 1, wherein the central adjusting element comprises at least one rotational bearing element, via which the vibration exciter can be arranged and held on at least one external fixed point of a machine.

5. A vibration exciter according to claim 1, wherein a main extension axis ($A_{SE}$) of the central adjusting element extends coaxially to an axis of symmetry ($A_S$) of the two unbalance shafts.

6. A vibration exciter according to claim 1, wherein a rotational force element is provided for vector adjustment and an axial force element for amplitude adjustment, which are both in operative connection with the central adjusting element.

7. A vibration exciter according to claim 6, wherein the rotational force element and the axial force element are arranged on one side of the vibration exciter.

8. A vibration exciter according to claim 6, wherein the rotational force element and the axial force element are functionally coupled with each other in such a way that an amplitude adjustment also occurs in the case of a vector adjustment.

9. A vibration exciter according to claim 6, wherein the rotational force element and the axial force element are functionally coupled with each other in such a way that in the case of a vector adjustment of the resulting excitation force of the excitation vibration from a vertical direction in the direction of a horizontal direction an amplitude adjustment is performed in such a way that the resulting excitation force is reduced.

10. A vibration exciter according to claim 6, wherein the axial force element comprises a coupling element which can be arranged between the vibration exciter and an external fixed point of a machine, with the coupling element being in a spiral-groove driving engagement with the central adjusting element in such a way that a rotational motion initiated by the rotational force element on the vibration exciter is converted into an axial motion of the adjusting element.

11. A vibration exciter according to claim 1, wherein the central adjusting element is arranged at least in part as a hollow shaft, which is arranged as a rotational shaft or a rotational bearing shaft for the vector adjustment.

12. A vibration exciter according to claim 6, wherein the rotational force element comprises a length-adjustable lifting cylinder which can be arranged eccentrically in relation to the central adjusting element on the vibration exciter and an external fixed point of a machine and especially a vibration tamper in such a way that with a change in length it causes a rotational movement of the vibration exciter coaxially to a main extension axis ($A_{SE}$) of the central adjusting element.

13. A machine with a vibration exciter according to claim 1.

14. A machine according to claim 13, wherein the machine comprises a vibration tamper.

15. A machine according to claim 10, wherein the machine comprises a vibration tamper.

* * * * *